US006985807B2

(12) United States Patent
Asano et al.

(10) Patent No.: US 6,985,807 B2
(45) Date of Patent: Jan. 10, 2006

(54) INJECTION QUANTITY CONTROLLER FOR AN INTERNAL COMBUSTION ENGINE

(75) Inventors: Masahiro Asano, Kariya (JP); Eiji Takemoto, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/973,441

(22) Filed: Oct. 27, 2004

(65) Prior Publication Data

US 2005/0107943 A1 May 19, 2005

(30) Foreign Application Priority Data

Nov. 13, 2003 (JP) ..... 2003-383898

(51) Int. Cl.
*F02D 41/30* (2006.01)

(52) U.S. Cl. ..... 701/104

(58) Field of Classification Search ..... 701/104, 701/105, 103, 115; 123/478, 480
See application file for complete search history.

(56) References Cited

U.S. PATENT DOCUMENTS

| | | | | |
|---|---|---|---|---|
| 4,483,300 | A * | 11/1984 | Hosaka et al. | 123/673 |
| 6,694,945 | B2 * | 2/2004 | Kawaguchi et al. | 123/299 |
| 6,907,861 | B2 * | 6/2005 | Asano et al. | 123/395 |
| 2004/0267433 | A1 | 12/2004 | Asano et al. | 701/104 |

FOREIGN PATENT DOCUMENTS

JP A-2002-310146 11/2000

* cited by examiner

*Primary Examiner*—Hieu T. Vo
(74) *Attorney, Agent, or Firm*—Nixon & Vanderhye P.C.

(57) ABSTRACT

The present invention performs an injection quantity learning process with only data acquired within a prescribed time. When the number of pieces of accumulated data reaches a prescribed count, a controller determines whether a time difference between when an oldest piece of data was acquired and when a latest piece of data was acquired is less than the prescribed time. When the difference is less than the prescribed time, the controller corrects a command quantity based on the prescribed number of pieces of data. According to this method, when the injection quantity is corrected, old data having been acquired before the prescribed time is discarded and the command quantity is corrected using only the prescribed number of pieces of data having acquired within the prescribed time, thereby enhancing learning accuracy.

20 Claims, 6 Drawing Sheets

INJECTION QUANTITY CONTROLLER FOR AN INTERNAL COMBUSTION ENGINE

CROSS REFERENCE TO RELATED APPLICATION

This application is based upon and claims the benefit of priority of Japanese Patent Application No. 2003-383898, filed Nov. 13, 2003, the contents of which are incorporated herein by reference.

FILED OF THE INVENTION

The present invention related to an injection quantity controller for an internal combustion engine that performs an injection quantity learning process to correct a difference between an actual injection quantity and a command injection quantity.

BACKGROUND OF THE INVENTION

Conventionally, pilot injection operations are performed on diesel engines to reduce combustion noise and Nox emissions. A pilot injection operation injects a minute quantity of fuel into a combustion chamber of the diesel engine prior to a main injection operation. However, for a pilot injection operation to have optimal effect (i.e., reduce combustion noise an Nox emissions), the accuracy of the quantity of the injection must be high.

The present application provides an injection quantity learning process that corrects a difference between an actual quantity of fuel injected (hereinafter referred to as the actual quantity) and a predetermined command quantity (hereinafter referred to as the command quantity) (Japanese Patent Application JP 2003-185633). According to this type of injection quantity learning process, a learning injection operation is performed when an engine is in an idle state, for example, when the command quantity of fuel for the injectors is zero. Then, the actual injection quantity is estimated based on a change of a state of operation of the engine (e.g., engine speed variation, A/F, and the like) caused by the injection. Finally, the difference between the actual quantity and the command quantity is determined and corrected. The difference between the actual quantity and the command quantity is usually caused by functional differences among the injection products including the injector.

The difference is finally corrected according to a plurality of pieces of data acquired from each of the individual cylinders. For example, N pieces of data for N cylinders are averaged to determine an appropriate correction. This is because actual injection quantities are different for different injectors even if the injectors are commanded to inject the same quantity of fuel.

However, even when utilizing the averaging method just described, old data may lead to erroneous learning or a reduction in learning accuracy. This is true because the injection products tend to function differently with age and the old data may not accurately reflect the present injection quantity difference.

SUMMARY OF THE INVENTION

The present invention provides an injection quantity controller for an internal combustion engine that enhances learning accuracy by performing an injection quantity learning process with only data acquired within a predetermined period of time.

The injection quantity controller of the present invention first determines if learning conditions are satisfied. Then, the controller performs a learning injection operation with injectors attached to each cylinder of an internal combustion engine. The injection quantity controller than acquires data representative of a change of state of operation of the engine. The change of state indicates an influence of the learning injection operation on each cylinder. The injection quantity controller then determines which of the acquired data is usable and calculates a correction quantity based on the usable data. Finally, the injection quantity controller adjusts the command injection according to the correction quantity. The injection quantity controller includes a data determiner for determining what acquired data is usable.

Upon acquiring a predetermined number of pieces of data, hereinafter referred to as the prescribed number of pieces of data, the data determiner determines whether a difference between when an oldest piece of data was acquired and when a latest piece of data was acquired is less than or equal to a predetermined time period, hereinafter referred to as the prescribed time. The data determiner determines that the prescribed number of pieces of data are usable when they are determined to have been acquired within the prescribed time.

Accordingly, learning accuracy is enhanced because old data is not used to calculate the correction. Only the pieces of data acquired within the prescribed time are used.

In the injection quantity controller of the present invention, when the data determiner determined that the time difference between when the oldest data was acquired and when the latest data was acquired exceeds the prescribed time, it discards the old data. As a result, the total number of pieces of data decreases below the prescribed count. Therefore, newly acquired data becomes the latest data and the total number of pieces of data once again equates to the prescribed count.

Another injection quantity controller of the present invention, when learning conditions are satisfied, performs a learning injection operation with an injector attached to each cylinder of an internal combustion engine. The injection quantity controller first acquires representative of a change of state of operation of the engine. The change of state indicates the influence of the learning injection operation on each of the cylinders. Then, the injection quantity controller determines whether the acquired data is usable. Finally, the injection quantity controller calculates a correction quantity based on the usable data and adjusts a command quantity according to the correction quantity. The injection quantity controller includes a data determiner for determining whether acquired data is usable.

The data determines the data to be usable when they were acquired either before a first expiration or after a second expiration. The first expiration is defined as occurring a prescribed time after the acquisition of the oldest piece of data. The second expiration is defined as occurring the prescribed time before the acquisition of the latest piece of data. Therefore, old data acquired before the prescribed time does not coexist with data acquired during the prescribed time and learning accuracy can be enhanced.

In one embodiment, if the prescribed number of pieces of data to be acquired within the prescribed period of time is not specified (for example, a prescribed count as described in claim 1 is not set), the data acquired within the prescribed period of time is used to calculate the correction quantity. Additionally, if the total number of pieces of data exceeds the prescribed count and all have been acquired within the prescribed time, a correction quantity to calculated using the excess data and, therefore, further enhancing the learning accuracy.

In any of the injection quantity controllers described above, the data determiner may also assign a weight factor to each piece of data acquired within the prescribed period of time. The latest acquired data is assigned a higher weight factor than the older data acquired within the prescribed time. Therefore, the correction quantity calculator the correction quantity using only the data to which weight factors are assigned.

Furthermore, calculating the correction quantity using only the higher weighted data can enhance the learning accuracy because the higher weighted data more accurately reflects a current state of the system.

In any of the injection quantity controllers described above, the data acquirer may start data acquisition from the first cylinder to reach a top dead center after the learning conditions are satisfied. This enables the learning process to be immediately started and completed in a short time.

In any of the injection quantity controllers described above, the data acquirer may compare the number of pieces of acquired data for each cylinder and acquire data from a selected cylinder in preference to the other cylinders.

When it is impossible to acquire data for each injection (for example, when data can be acquired only once per rotation of the engine because one rotation is required to detect a state of change of the engine) without acquiring data from a cylinder (the first cylinder to reach a top dead center after learning conditions are satisfied) immediately after learning conditions are satisfied, data is acquired from the selected cylinder in preference to other cylinders (that is, data is acquired intensively from a selected cylinder, or evenly from all cylinders). With this, learning time can be reduced and the correction of all cylinders can be performed early. In one embodiment, the selected cylinder is defined as the cylinder having the largest number of pieces of data previously acquired therefrom.

In this case, by acquiring data from cylinders having a relatively large number of pieces of data in preference to other cylinders, without discarding data acquired previously because of the elapse of the prescribed time, learning can be completed in a short time.

In any of the injection quantity controllers described above, the data determiner may alternatively determine whether acquired data is usable based on a vehicle traveling distance or an operation frequency of the injector.

The difference between the quantity of fuel actually injected from an injector (actual injection quantity) and the command quantity often occurs due to a physical change of the injector over time. The data determiner may also determine whether acquired data is usable, not from elapsed time from data acquisition time, but from a vehicle traveling distance or an injector operation frequency that influences a change of the injector over time.

For example, when the number of pieces of acquired data reaches the prescribed count, the data determiner may determine whether a traveling distance (or injector operation frequency) between when the old data was acquired and (or injector operation frequency) when the latest data was acquired is less than or equal to a predetermined distance, hereinafter referred to as the prescribed distance (or prescribed operation frequency). If the is distance is less than or equal to the prescribed distance (or prescribed operation frequency), the data determiner determines which pieces of the data are usable.

The data determiner determines that the data acquired within the passage of the prescribed distance (or injector operation frequency) is usable.

In any of the injection quantity controllers described above, the learning condition determiner may define the learning condition as when a command injection quantity of fuel is less than or equal to zero.

Thereby, a change of state of the internal combustion engine caused by the learning injection can be correctly detected and an injection quantity learning process can be accurately executed. In one embodiment, the non-injection time occurs when a command injection quantity is zero or less identifying the engine to be in an idle state such as a shift change or during deceleration;

Other features and advantages of the present invention will be appreciated, as well as methods of operation and function of the related parts from a study of the following detailed description, appended claims, and drawings, all of which form a part of this application. In the drawings:

DETAILED DESCRIPTION OF THE PREFERRED EMBODIMENTS

First Embodiment

Figure 4:
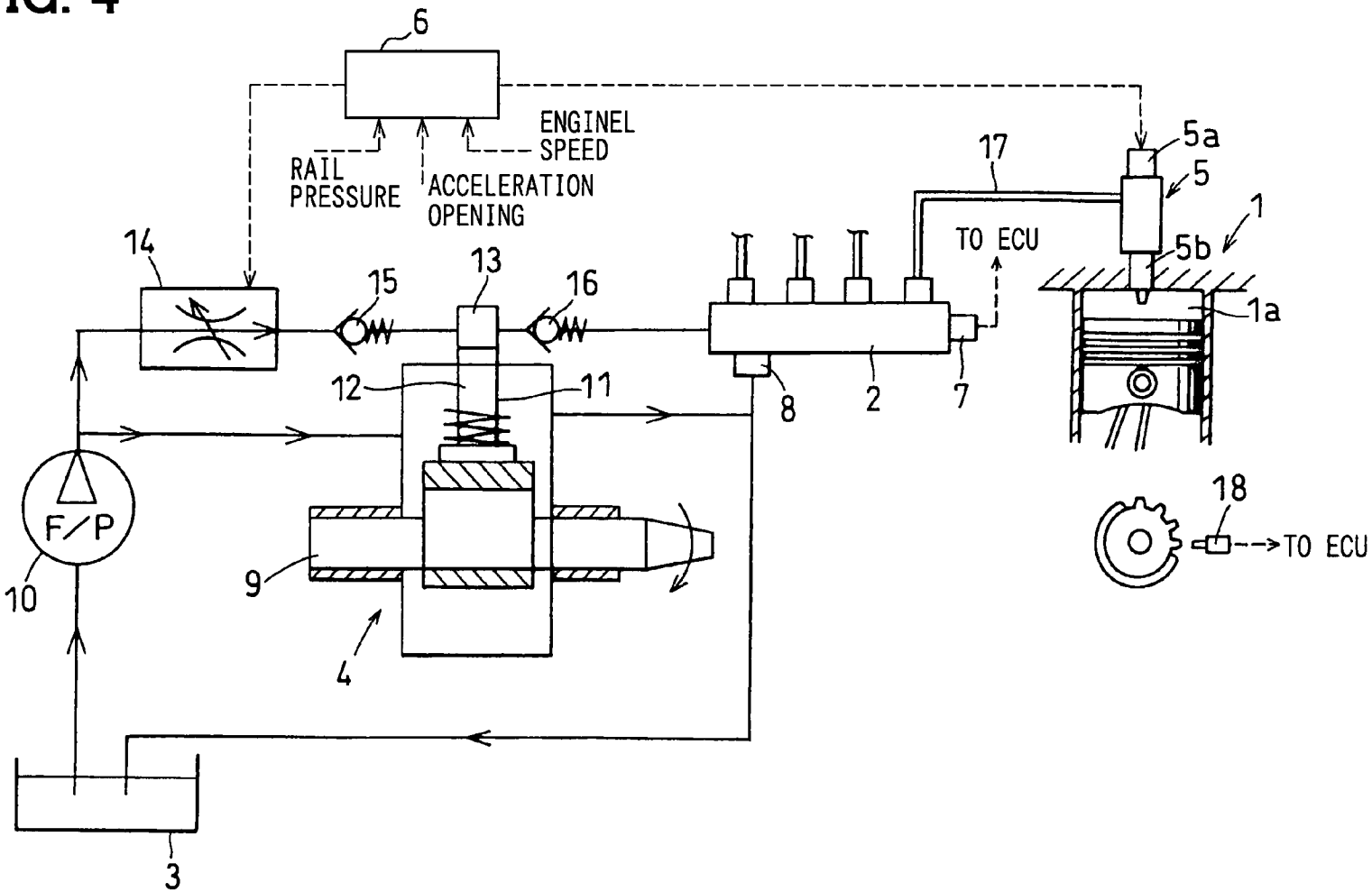
FIG. 4 is a schematic diagram of a fuel injection system for a diesel engine in accordance with the present invention.

FIG. 4 depicts a fuel injection system for a diesel engine configured in accordance with the principles of the present invention. The diesel engine includes a four-cylinder diesel engine (hereinafter referred to as an engine 1) having a fuel injection device.

The fuel injection device includes a common rail 2, a fuel pump 4, an injector 5, and an electronic control unit 6. The common rail 2 stores high-pressure fuel. The fuel pump 4 pressurizes fuel pumped from a fuel tank 3 and supplies it to the common rail 2. The injector 5 injects high-pressure fuel supplied from the common rail 2 to a cylinder (combustion chamber 1*a*) of the engine 1. The electronic control unit 6, hereinafter referred to as the ECU 6, controls the system.

The common rail 2 accumulates high-pressure fuel supplied by the fuel pump 4 to a target rail pressure that is set by the ECU 6. The common rail 2 includes a pressure sensor 7 and a pressure limiter 8. The pressure sensor 7 detects a fuel pressure and outputs a pressure value to the ECU 6. The pressure limiter 8 limits the pressure in the common rail 2 to be less than or equal to a pressure threshold value.

The fuel pump 4 includes a camshaft 9, a feed pump 10, a plunger 12, and an electromagnetic metering valve 14. The engine 1 drives the camshaft 9. The camshaft 9 drives the feed pump 10 to pump fuel from the fuel tank 3. The plunger 12 reciprocates in a cylinder 11 synchronously with the rotation of the camshaft 9. The electromagnetic metering valve 14 meters a quantity of fuel transferred to a pressure chamber 13 of the cylinder 11 by the feed pump 10.

While the plunger 12 travels within the cylinder 11 from a top dead center position to a bottom dead center position, fuel fed by the feed pump 10 pushes open an inlet valve 15 and travels into the pressure chamber 13. Alternatively, when the plunger 12 travels within the cylinder 11 from the bottom dead center position to the top dead center position, it pressurizes the fuel in the pressure chamber 13. The pressurized fuel pushes open a delivery valve 16 and forcefully travels into the common rail 2.

The injector 5 is disposed atop each of the cylinders of the engine 1 and communicates with the common rail 2 via a high-pressure piping 17. The injector 5 includes a solenoid valve 5*a* and a nozzle 5*b*. The solenoid valve 5*a* operates based on commands from the ECU 6. The nozzle 5*b* injects fuel when the solenoid valve 5*a* is electrified.

The solenoid valve 5*a* operates to open and close a low-pressure passage (not shown). The low-pressure passage is disposed between a pressure chamber (not shown) to which high-pressure fuel of the common rail 2 is supplied and a low-pressure side. The solenoid valve 5*a* opens the low-pressure passage when energized with an electric current and closes the low-pressure passage in the absence of an electric charge.

The nozzle 5*b* incorporates a needle (not shown) that opens and closes an injection hole (not shown). Fuel pressure of the pressure chamber urges the needle in closing direction (the direction that shuts the injection hole). Accordingly, upon energizing the solenoid valve 5*a* and opening the low-pressure passage, the fuel pressure in the pressure chamber decreases. This causes the needle to rise in the nozzle 5*b* and open the valve (opens the injection hole). As a result, the high-pressure fuel supplied from the common rail 2 is injected through the injection hole. Alternatively, when the low-pressure passage is closed due to a lack of electric current supplied to the solenoid valve 5*a*, the fuel pressure in the pressure chamber increases. This causes the needle to descend within the nozzle 5*b* and close the valve to terminate further injection.

The ECU 6 is connected to an rpm sensor 18, an acceleration sensor (not shown), and a pressure sensor 7. The rpm sensor 18 detects an engine speed. The acceleration sensor detects an acceleration opening (engine load). The pressure sensor 7 detects a rail pressure. Based on the information detected by these sensors, the ECU 6 calculates a timing of the fuel injection, an injection quantity for the target rail pressure of the common rail 2, and an operating state of the engine 1. According to the calculated results, the ECU 6 controls the electromagnetic metering valve 14 of the fuel pump 4 and the solenoid valve 5*a* of the injector 5.

The ECU 6 executes an injection quantity learning process to a correct a difference between a command quantity of fuel sent to the injector 5. To perform the injection quantity learning process, the ECU 6 includes a learning condition determiner 6*a*, a learning injection commander 6*b*, a data acquirer 6*c*, a data determiner 6*d*, a correction quantity calculator 6*e*, and an injection quantity corrector 6*f*.

Figure 5:
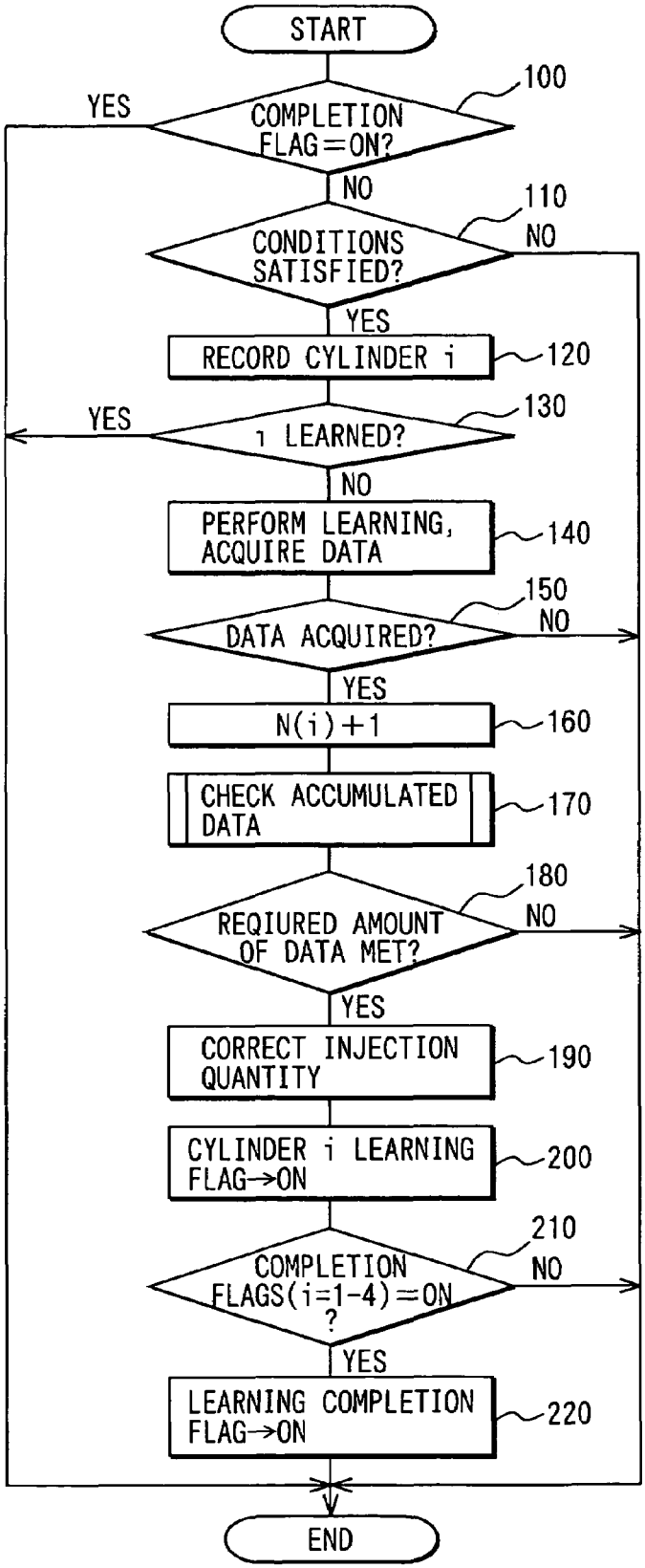
FIG. 5 is a flowchart of an injection quantity learning process in accordance with the fuel injection system of FIG. 4.

With reference to FIG. 5, an exemplary injection quantity learning process performed by the ECU 6 of the present invention will now be described.

Initially, it should be understood that the ECU 6 performs the injection quantity learning process of a four-cylinder engine 1 in the following order, first cylinder (indicated as #1), third cylinder (#3), fourth cylinder (#4), second cylinder (#2).

Step 100: The ECU 6 checks a learning completion flag. The flag identifies whether the injection quantity learning process has been completed for all the cylinders (#1 to #4) of the engine 1. If the flag is set to 'ON,' the learning has been completed for all the cylinders and the ECU 6 terminates the process. If the flag is set to 'OFF,' the ECU 6 proceeds to Step 110.

Figure 2:
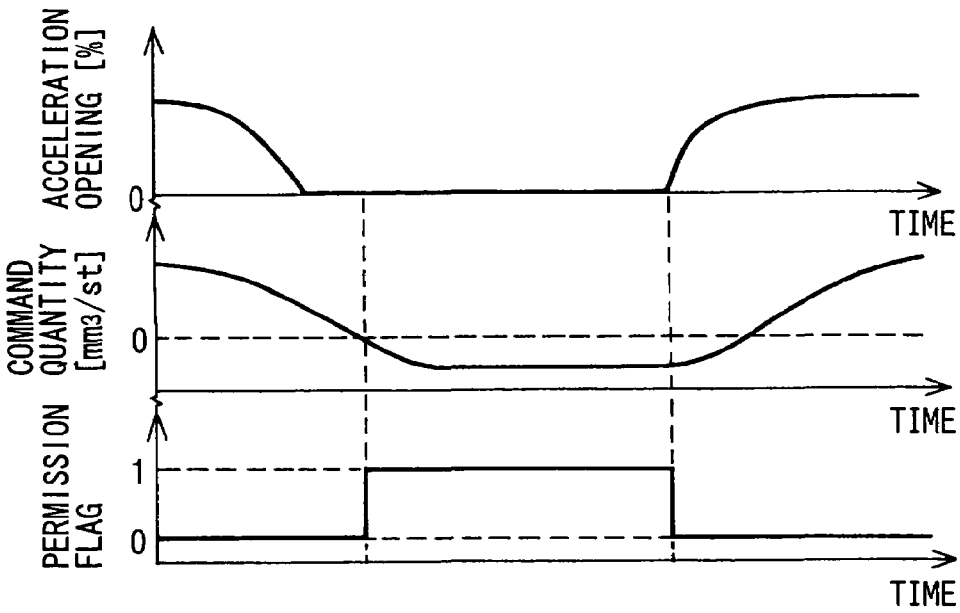
FIG. 2 provides graphs illustrating the establishment of learning conditions in accordance with the present invention.
Figure 3:
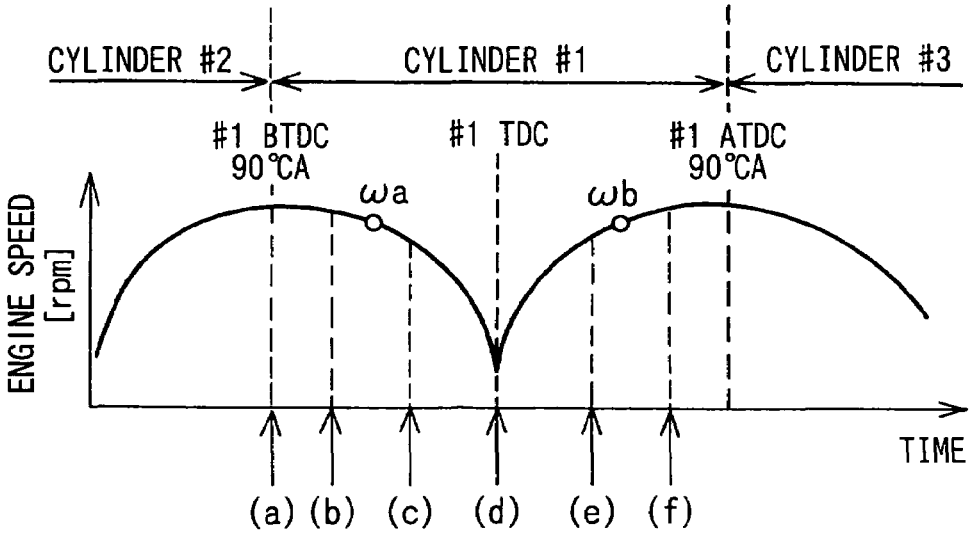
FIG. 3 is graph illustrating a data acquisition sequence in accordance with the present invention.

Step 110: The ECU 6 determines whether learning conditions are satisfied. The learning conditions include acceleration opening=0 and command injection quantity $\leqq 0$, as shown in FIG. 2. In this embodiment, a cylinder between 90° CA of the latter half of a compression stroke and 90° CA of the first half of an expansion stroke is defined as an injection cylinder, as shown in FIG. 3. Therefore, the learning conditions are satisfied each time the injection cylinder changes (every 180° CA).

Upon determining that the learning conditions are satisfied (Step 110: YES), the ECU 6 sets the learning permission flag to "1" and proceeds to Step 120; otherwise, the ECU 6 sets the learning permission flag to "0" and terminates the process.

Step 120: The ECU 6 records a number "i" of current injection cylinder.

Step 130: The ECU 6 determines whether an injection quantity learning process has been completed for injection cylinder "i." If the ECU 6 determines that an injection quantity learning process has been completed for cylinder "i" (Step 130: YES), it terminates the process. If the ECU 6 determines that an injection quantity learning process has not been completed for cylinder "i" (Step 130: NO), it proceeds to Step 140.

Step 140: The ECU 6 performs the injection quantity learning process on cylinder "i." Furthermore, the ECU 6 acquires data (e.g., engine speed) for calculating a quantity of change of a state of the engine (e.g., engine speed change) to be used to identify the influence of the learning injection.

With reference to FIG. 3, a data acquisition process is described in more detail.

At point (a) along the time axis of the graph, the ECU 6 determines if the learning conditions are satisfied. When the learning conditions are satisfied and the learning permission flag is set to 1, the ECU 6 proceeds to points (b) through (f).

At point (b), the ECU 6 meters an engine speed ωa prior to executing the injection quantity learning process.

At point (c), the ECU 6 terminates metering the engine speed ωa. Therefore, the engine speed ωa corresponds to an average engine speed between points (b) and (c) and is calculated from required time and a rotational angle between points (b) and (c).

At point (d), the ECU 6 performs the injection quantity learning process.

At point (e), the ECU 6 meters an engine speed ωb after the execution of injection quantity learning process.

At point (f), the ECU 6 terminates metering the engine speed ωb. Therefore, the engine speed ωb corresponds to an average engine speed between points (e) and (f) and is calculated from required time and rotational angle between points (e) and (f).

Therefore, it should be appreciated that the ECU 6 performs the injection quantity learning process immediately prior to TDC so that ignition is performed in the vicinity of TDC of an injection cylinder (#1 in FIG. 3).

Referring back to FIG. 5, the portion of the injection quantity learning process performed subsequent to acquiring the data is described.

Step 150: The ECU 6 determines whether the data has been successfully acquired. The ECU 6 checks whether the learning conditions indicated in Step 110 have been maintained without normal injection returning or rail pressure changing before the data was acquired. When the ECU 6 determines that the data has been successfully acquired (Step 150: YES), it proceeds to Step 160; otherwise, it terminates the process.

Step 170: The ECU 6 adds 1 to a total number of pieces N(i) of accumulated data for cylinder #i and proceeds to Step 170.

Step 170: The ECU 6 checks the accumulated data to determine if it is usable, which will be described in more detail with below reference to FIG 6.

Step 180: The ECU 6 determines whether the total number of pieces N (i) of accumulated data is greater than or equal to a prescribed count N, which is set to three in this embodiment. When the prescribed count N of pieces of data has been reached (Step 180: YES), the ECU 6 proceeds to Step 190; otherwise, it terminates the process.

Step 190: The ECU 6 corrects the command injection quantity for cylinder #i. One injection quantity correction process is disclosed in JP-A No.2000-310146. First, the ECU 6 estimates an actual quantity (the quantity of fuel actually injected from the injector 5) based on a engine speed variation occurring as a result of the learning injection. Then the ECU 6 compensates for any difference between the actual quantity and the command quantity. The ECU 6 calculates the engine speed variation from the engine speed ωa detected immediately after the learning injection operation. The ECU 6 calculates a correction quantity by averaging the N pieces of accumulated engine speed variation data. Subsequent to correcting the injection quantity, the ECU 6 proceeds to Step 200.

Step 200: The ECU 6 sets a learning completion flag for cylinder #i to 'ON' and proceeds to Step 210.

Step 210: The ECU 6 determines whether learning completion flags for all cylinders (i=1–4) are set to 'ON.' When the flags are 'ON' for all cylinders (Step 210: YES), the ECU 6 proceeds to Step 220; otherwise it terminates the process.

Step 220: The ECU 6 sets the learning completion flag to 'ON' and terminates the process. It should be appreciated that the learning completion flags described in Steps 200 and 210 are flags assigned to each of the individual injection cylinders #1 to #4, while the learning completion flag described in Steps 220 and 100 is a flag for identifying whether or not learning for all the cylinders has been completed. Thus, the completion flag of Steps 220 and 100 is only set to 'ON' when each of the four learning flags associated with each of the four cylinders #1 to #4 are set to 'ON' same time.

Figure 6:
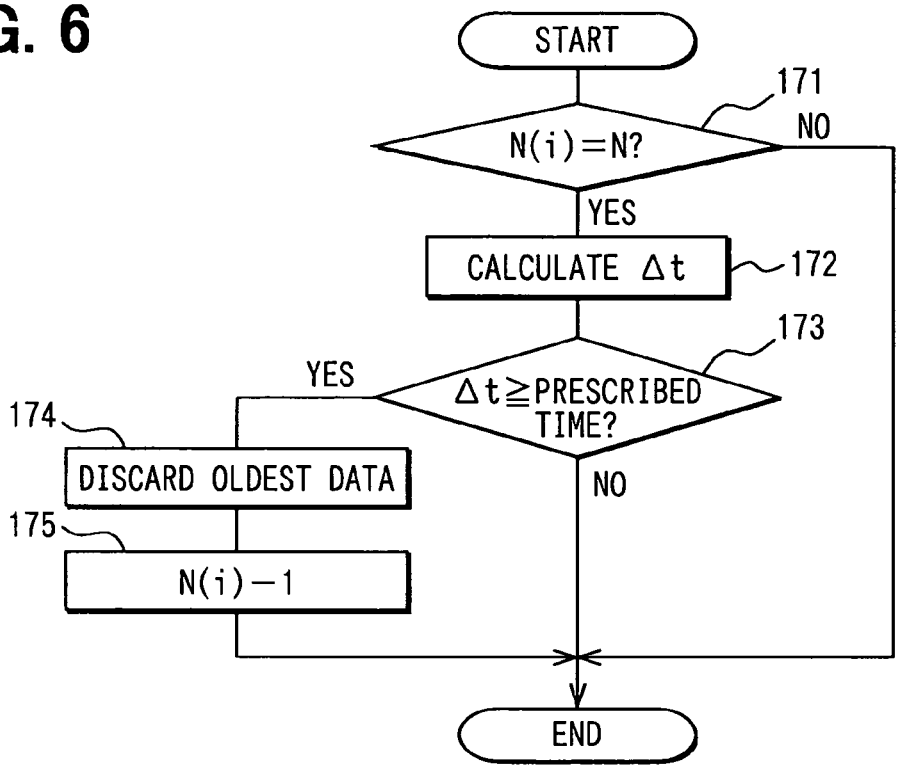
FIG. 6 is a flowchart of a first embodiment of a data checking process of the injection quantity learning process of FIG 5.

With reference to FIG. 6, a first embodiment of the accumulated data checking mentioned in Step 170 will be described in more detail.

Step 171: The ECU 6 determines whether the number of pieces N (i) of accumulated data has reached the prescribed count N. When N(i)=N (Step 171: YES), the ECU 6 proceeds to Step 172; otherwise, it terminates the checking process and proceeds to Step 180 of FIG. 5.

Step 172: Among the N pieces of data, the ECU 6 calculates a time difference Δt between an acquisition time of the oldest data and an acquisition time tn of the latest data.

Step 173: The ECU 6 determines whether the time difference Δt calculated in Step 172 is equal to or greater than a prescribed time. When Δt≧ the prescribed time (Step 173: YES), The ECU 6 proceeds to Step 174; otherwise, the ECU 6 terminates the checking process and proceeds to Step 180 of FIG. 5.

Step 174: The ECU 6 discards the oldest data from the N pieces of data.

Step 175: The ECU 6 decreases the total number of pieces of accumulated data N(i) by the number of pieces of discarded data, terminates the checking process, and proceeds to Step 180 of FIG. 5.

Figure 1:
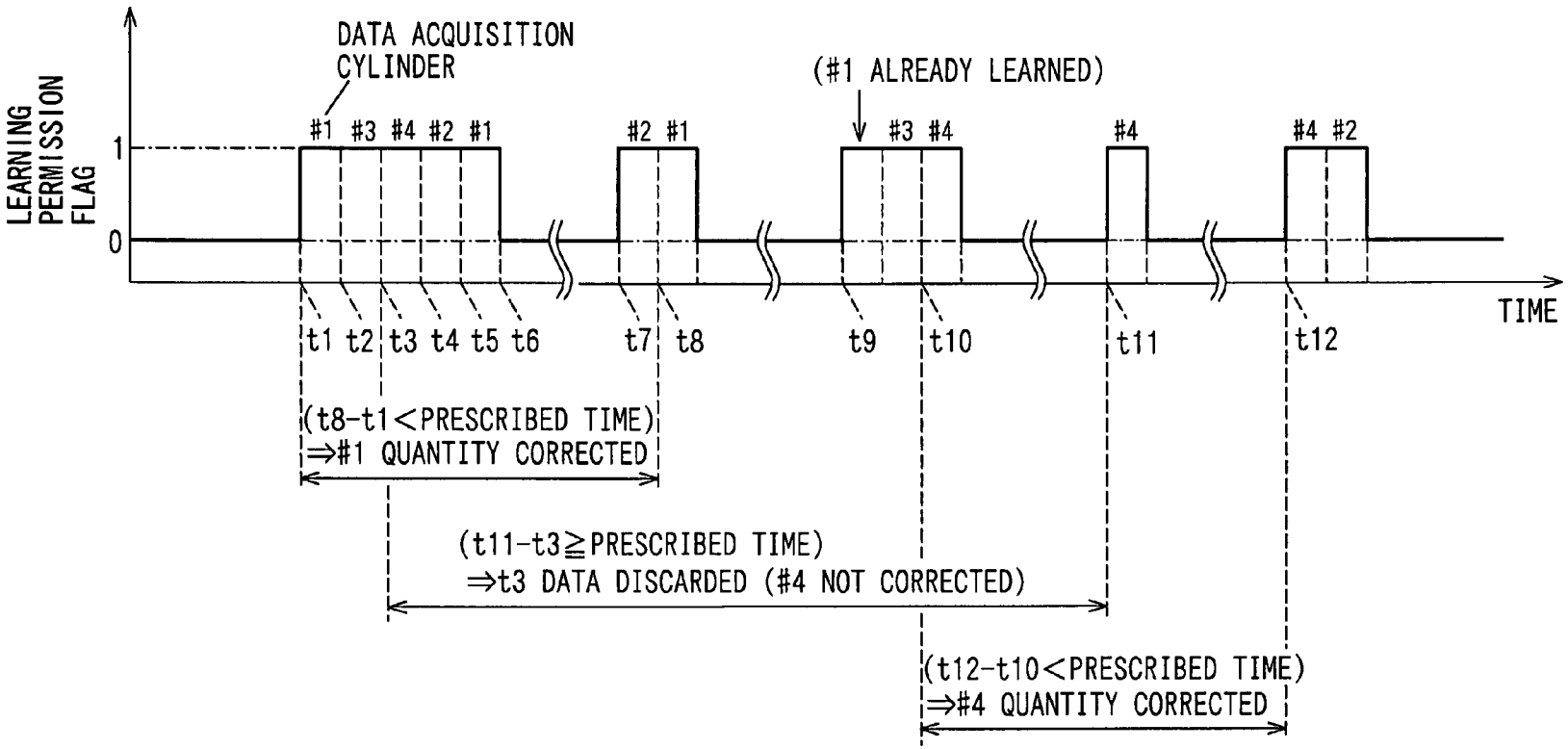
FIG. 1 is an explanatory diagram illustrating a data acquisition sequence of an injection quantity learning process in accordance with a first embodiment of the present invention.

The injection quantity learning process of this embodiment is based on a timing chart shown in FIG. 1.

The ECU 6 performs the data acquisition processing described in Step 140 when the learning permission flag becomes "1" at time t1 indicated on the horizontal axis of FIG. 1. In FIG. 1, the ECU 6 performs data acquisition on cylinder #1 between t1 and t2. Then, the ECU 6 performs data acquisition in the order of #3, #4, #2, and #1 until t6, at which time the ECU 6 sets the learning permission flag to "0." When the learning permission flag is set to "0" at t6, the ECU 6 ceases data acquisition. The ECU 6 again performs the data acquisition process at t7 when the learning permission flag is set to "1."

Upon the number of pieces of acquired data N(i) of cylinder #i reaching the prescribed count N (three), the ECU 6 corrects the command quantity. To perform the correction, all three pieces of data must have been acquired within the prescribed time.

Accordingly, when N pieces (three) of data for cylinder #1 have been acquired at time t8, ECU 6 calculates a time difference Δt between time t1, which is when the oldest data was acquired, and time t8, which is when the latest data was acquired. The ECU 6 then determines whether the time difference Δt is within the prescribed time. If the time difference Δt is within the prescribed time (that is, all of the three pieces of data have been acquired within the prescribed time), the ECU 6 corrects the command quantity for cylinder #1 based on the three pieces of data.

Upon completion of the injection quantity correction for cylinder #1, the ECU 6 ceases acquiring data for cylinder #1.

On the other hand, although FIG. 1 illustrates that three pieces of data have been acquired for cylinder #4 at t11, the ECU 6 will not correct the command quantity for cylinder #4. This is because a time difference Δt between time t3, which is when the oldest data was acquired, and time t11, which is when the latest data was acquired, exceeds the prescribed time. Furthermore, the data (oldest data) acquired at t3 is outside of the prescribed time and is therefore discarded. At this point, the number of pieces of accumulated data of #4 becomes two. Subsequently, when data is accumulated at t12, the number of pieces becomes three and the ECU determines whether a time difference Δt between acquisition time t10 of the oldest data and acquisition time t12 of the latest data is within the prescribed time. Since the time difference Δt is within the prescribed time, the ECU 6 performs the injection quantity correction for cylinder #4 based on the three pieces of accumulated data.

Effect of the First Embodiment

In the injection quantity learning process of the first embodiment, the ECU 6 first determines whether a prescribed number of pieces of data have been accumulated. Then the ECU 6 determines whether a time difference between when the oldest data was acquired and when the latest data was acquired is within a prescribed time. When the time difference is within the prescribed time, the ECU 6 corrects the command quantity based on the prescribed number of pieces of data. According to this method, when the ECU 6 performs the correction, old data acquired prior to the prescribed time is discarded and the command quantity is corrected based only on the prescribed number of pieces of data that were acquired within the prescribed time. Consequently, learning accuracy is enhanced.

Second Embodiment

Figure 7:
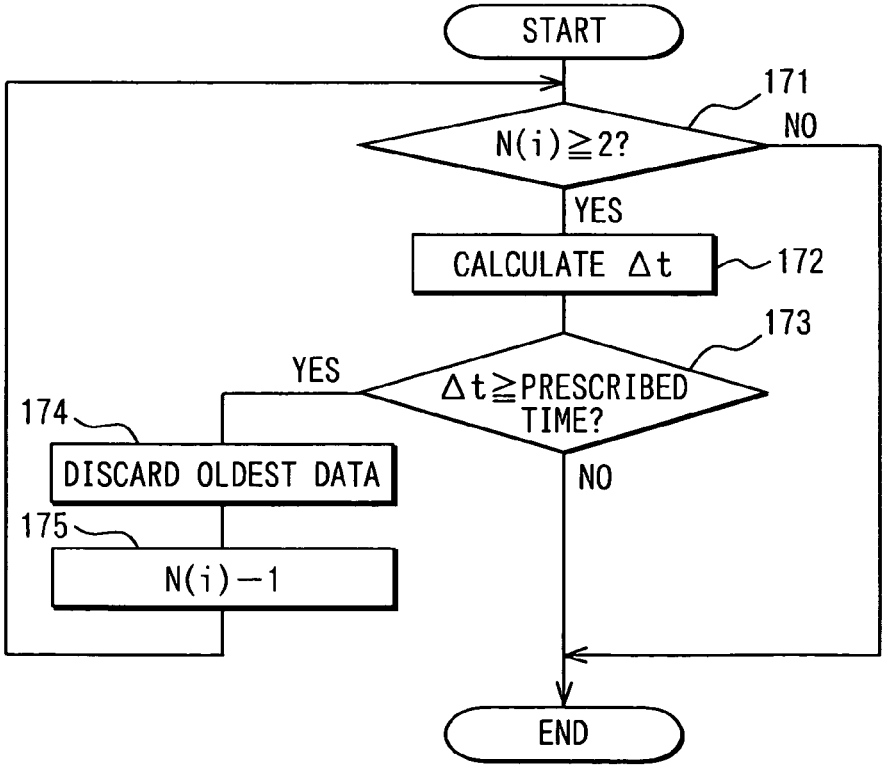
FIG. 7 is a flowchart of a second embodiment of the data checking process of the injection quantity learning process of FIG. 5.

FIG. 7 provides a second embodiment for checking the accumulated data in accordance with Step 170 of FIG. 5.

The checking process of the second embodiment is different from the first embodiment in that the ECU 6 returns to Step 171 after executing Step 175. Furthermore, the determination made by the ECU 6 in Step 171 is slightly different. Processing steps 172 to 174 are the same.

That is, the first embodiment, the ECU 6 checks the data when the number of pieces of accumulated data N(i) reaches the prescribed count N (Step 171: YES). However, in the second embodiment, the ECU 6 checks the data before the number of pieces N(i) reaches the prescribed count N and discards all data outside the prescribed time. Specifically, at step 171, the ECU 6 proceeds to calculating the time difference Δt when N(i) is greater than or equal to 2.

Third Embodiment

In the first embodiment, the ECU 6 does not correct the command injection quantity until a prescribed number N of pieces of data are acquired within the prescribed time. In a third embodiment, however, if the number of pieces of accumulated data is not greater than or equal to the prescribed count when the prescribed time lapses, the ECU 6 corrects the command injection quantity using the available data. Therefore, in FIG. 5, described above, Step 180 is eliminated in the third embodiment.

However, like the first embodiment, the ECU 6 of the third embodiment corrects the command quantity using only data acquired within the prescribed time. Any old data, which was acquired before the prescribed time, is discarded. Consequently, learning accuracy is enhanced.

It should be understood that in the third embodiment, the prescribed number of pieces of data to be accumulated within the prescribed time is not specified. Therefore, the ECU 6 corrects the command injection quantity based on the data accumulated during the prescribed time. This allows the injection quantity learning process to be completed in a short time. For example, referring to FIG. 1, in the first embodiment, even if three pieces of data for cylinder #4 are accumulated at time t11, the ECU 6 does not correct the injection quantity for cylinder #4 because the time difference Δt between time t3, which is when the oldest data was acquired, and time t11, which is when the latest data was acquired, exceeds the prescribed time.

In contrast to this, in the third embodiment, the ECU 6 corrects the command injection quantity each time the elapsed time reaches the prescribed time. For example, the first data for cylinder #4 is acquired at t3, thereby initiating the prescribed time to begin running. When the time reaches somewhere between t10 and t11, which is when the prescribed time expires, the ECU 6 corrects the command injection based on whatever data it has acquired up to that point (two pieces of data acquired at t3 and t10). The ECU 6 of the third embodiment is not concerned with the number of pieces of data. The ECU 6 is only concerned with the time at which the data was acquired. Therefore, injection quantity learning of cylinder #4 can be completed earlier than in the first embodiment.

Furthermore, it should be appreciated that the third embodiment may result in a correction based on more pieces of data than those prescribed in other embodiments because the ECU 6 is not concerned with the amount of data but only the time it was acquired. Therefore, the learning accuracy can be further enhanced.

Fourth Embodiment

In a fourth embodiment, the ECU 6 assigns weight factors to each piece of data that is acquired within the prescribed time.

It should be appreciated that newly acquired data more accurately reflects a current injection quantity than old data, even when the old and new data was acquired within the prescribed time. Therefore, the ECU 6 can increase learning accuracy by weighting the newer data higher than old data.

For example, the data may be weighted according to an expression for finding an average value of engine speed variation δ, as shown below and identified as Expression 1.

$$\delta ave = \frac{\frac{1}{(tn-t1)}\cdot\delta 1 + \frac{1}{(tn-t2)}\cdot\delta 2 + \frac{1}{(tn-t3)}\cdot\delta 3\cdots}{\frac{1}{(tn-t1)} + \frac{1}{(tn-t2)} + \frac{1}{(tn-t3)} + \cdots} \qquad \text{Expression 1}$$

δave: Average value of engine speed variation δ

δi: Engine speed variation acquired for an i-th time ti: Acquisition time of δi tn: Current time Fifth Embodiment In a fifth embodiment, the ECU 6 compares the number of pieces of accumulated data for each cylinder to acquire data from a selected cylinder in preference to other cylinders. that is, the data of a selected cylinder is intensely acquired, while data for all other cylinders is acquired uniformly.

For example, the first embodiment includes acquiring data from each injection cylinder. Therefore, data acquisition is started from a cylinder immediately after the learning permission flag has changed from "0" to "1". However, according to the first embodiment, data may be acquired only once per engine rotation. In such a case, rather than acquiring data from a cylinder immediately after learning conditions are satisfied, it may be better to wait for the next injection cylinder to acquire data.

Figure 8:
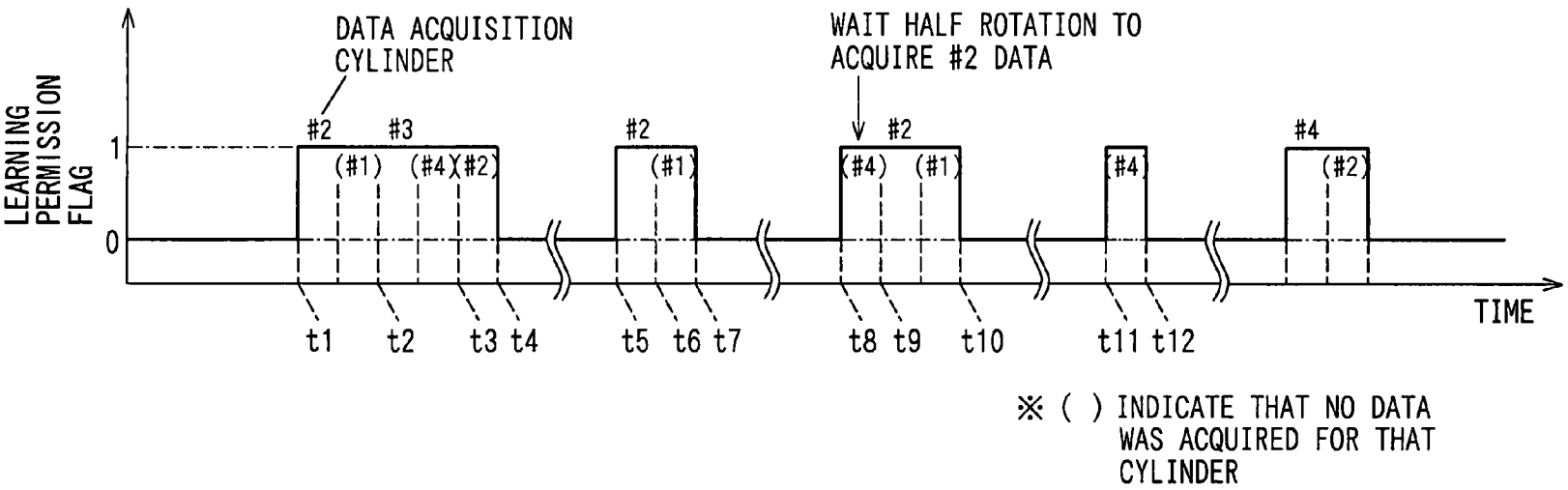
FIG. 8 is an explanatory diagram of a fifth embodiment of a data checking process of the injection quantity learning process of FIG. 5.

A concrete example of the fifth embodiment (the data of a selected cylinder is intensively acquired) is described with reference to FIG. 8. FIG. 8 depicts a study of the processing of data from learning injection to acquisition during which the engine makes one rotation. In this embodiment, the ECU 6 does not acquire data for a cylinder during periods which learning conditions are satisfied (learning permission flag=1) but expire prior to the engine completing a full rotation. For example, when an attempt to acquire data for cylinder #4 is made at time t11, wherein the learning permission flag is set to "1," the data is not acquired because the learning permission flag changes to "0" at t12, which is before the data acquisition can be completed.

Alternatively, when the learning permission flag is set to "1" at time t1, the ECU 6 performs the learning injection operation and data acquisition process for cylinder #2 during the time which the engine makes one rotation between t1 and t2. Similarly, the ECU 6 performs the learning injection operation and data acquisition process for cylinder #3 between times t2 and t3. However, if an attempt to acquire data for cylinder #2 is made at t3 or later, data acquisition cannot be completed because the learning permission flag changes to "0" at t4, which is before the completion of a full rotation.

When the learning permission flag changes to "1" at time t8, the ECU 6 waits a half rotation (180° CA) acquires data for cylinder #2 at t9 and t10 without acquiring data for cylinder #4. This is because at time t8, the number of pieces of data required for correcting cylinder #2 (e.g., three) will be satisfied with the acquisition of only one more piece of data.

Furthermore, during the time between t5 and t7, the learning permission flag is "1" for just one rotation. Therefore, while data for cylinder #2 can be acquired at t5, data may not be acquired for cylinder #1 after waiting for half the rotation because the learning permission flag changes from "1" to "0" before the data acquisition is completed.

According to the above-described process, a prescribed number of pieces of data required for the correction of the command quantity for cylinder #2 can be acquired earlier than in the first embodiment, wherein the data is acquired for each cylinder immediately after the learning permission flag has changed from "0" to "1". Therefore, correction is complete without having to discard previously acquired data.

An example of data acquisition for cylinder #2 has been described in the first embodiment for the case where the injection order for the four-cylinder engine 1 is cylinder #1, cylinder #3, cylinder #4, cylinder #2. Alternatively, the cylinders may be grouped such that cylinder #1 is paired with cylinder #4 and cylinder #3 is paired with cylinder #2. For example, consider cylinder (A) as being the injection cylinder immediately following the learning permission flag changing from "0" to "1". Additionally, consider cylinder (B) as the data acquisition cylinder. The data can be acquired as follows:

When the injection quantity correction process for cylinders #1 and #4 is performed earlier, (A) and (B) are combined as follows:

(B) is cylinder #1 when (A) is cylinder #1;

(B) is cylinder #4 when (A) is cylinder #3 (180° CA wait);

(B) is cylinder #4 when (A) is cylinder #4; and (B) is cylinder #1 when (A) is cylinder #2 (180° CA wait).

When the injection quantity correction process for cylinders #1 and #4 is completed, (A) and (B) are combined as follows:

(B) is cylinder #3 when (A) is cylinder #1 (180° CA wait);

(B) is cylinder #3 when (A) is cylinder #3;

(B) is cylinder #2 when (A) is cylinder #4 (180° CA wait); and (B) is cylinder #2 when (A) is cylinder #2.

When the correction of cylinder #1 is completed and correction of cylinder #4 is incomplete, (A) and (B) are combined as follows:

(B) is cylinder #3 when (A) is cylinder #1 (180° CA wait);

(B) is cylinder #4 when (A) is cylinder #3 (180° CA wait);

(B) is cylinder #4 when (A) is cylinder #4; and (B) is cylinder #2 when (A) is cylinder #2.

Which of the pairs cylinders, #1 and #4 or #3 and #2, to start acquiring data from first is determined according to when the learning permission flag first changes from "0" to "1".

As described above, by acquiring data for specific cylinders (e.g., #1 and #4) in preference to other cylinders (e.g., #3 and #2), the prescribed number of pieces of data can be acquired faster and the amount of discarded data can be reduced because the number of chances to acquire data for the specific cylinders (#1 and #4) increases.

While in the first embodiment, the injection quantity learning process is performed when the learning permission flag is set to "1", it should be appreciated that the accumulated data checking (Step 170) and injection quantity correction (Step 190) may be performed after the learning permission flag becomes "0". This would reduce a processing load on the ECU 6 during data acquisition.

Furthermore, in the first embodiment, an engine speed variation is disclosed as an example of the state of the engine that changes, thereby indicating the influence of the learning injection. In an alternative embodiment, the injection quantity correction process may also be performed according to a pressure change within the cylinder or an A/F change in addition to the engine speed variation.

Further yet, in the first embodiment, when N pieces of accumulated data have been acquired within a prescribed time, the injection quantity correction process is performed. However, in an alternative embodiment, the determination of whether to perform the injection quantity correction process or not may be based on a vehicle traveling distance or an operation frequency of the injector 5. For example, when accumulated data is checked in Step 170 (Steps 171 to 175 of the subroutine), among the N pieces of accumulated data, the ECU 6 determines whether a traveling distance (or an operation frequency of the injector 5) between when the oldest piece of data was acquired and (or an operation frequency of the injector 5) when the latest piece of data was acquired is within a prescribed distance (or a prescribed count). When it is within the prescribed distance (or prescribed count), the ECU 6 corrects the injection quantity based on the N pieces of accumulated data.

Similarly, in the third embodiment described above, the ECU 6 does not correct the injection quantity until a prescribed distance (or prescribed count) has passed from (or operation frequency of the injector 5) when the first piece of data was acquired.

What is claimed is:

1. An injection quantity controller for an engine, comprising:

a learning condition determiner for determining whether at least one predetermined learning condition is satisfied;

a learning injection commander for commanding at least one of a plurality of injectors each attached to one of a plurality of cylinders of the engine to inject a command quantity of fuel into the cylinders when the at least one learning condition is satisfied;

a data acquirer for acquiring a plurality of pieces of data for at least one of the plurality of cylinders, the plurality of pieces of data representing a change of an operating state caused by the command quantity of fuel;

a data determiner for identifying which of the plurality of pieces of data are usable;

a correction quantity calculator that calculates a correction quantity for correcting the command quantity based on the pieces of data determined to be usable by the data determiner; and an injection quantity corrector that corrects the command quantity according to the correction quantity.

2. The injection quantity controller according to claim 1, wherein the data determiner determines which of the piece of acquired data are usable only after a number of the plurality of pieces of data is at least equal to a prescribed count.

3. The injection quantity controller according to claim 2, wherein the data determiner identifies data as usable when a difference between when an oldest piece of data was acquired and when a latest piece of data was acquired is less than a prescribed time.

4. The injection quantity controller according to claim 3, wherein the data determiner discards the oldest piece of data and reduces the number of pieces of data by one upon determining that the difference between when the oldest data was acquired and when the latest data was acquired is greater than or equal to the prescribed time.

5. The injection quantity controller according to claim 1, wherein the data determiner identifies each of the pieces of data as usable when acquired one of before a first expiration and after a second expiration, wherein the first expiration is defined as being a prescribed time after the acquisition of the oldest piece of data and the second being defined as being the prescribed time before the acquisition of the latest piece of data.

6. The injection quantity controller according to claim 1, wherein the data determiner assigns a weight factor to each of the pieces of data that are determined to be usable and the correction quantity calculator calculates the correction quantity based on the data to which weight factors are assigned, wherein later acquired data is assigned a higher weight factor than older acquired data.

7. The injection quantity controller according to claim 1, wherein the data acquirer starts acquiring data from a first cylinder to reach a top dead center after the at least one learning condition is satisfied.

8. The injection quantity controller according to claim 1, wherein the data acquirer compares the numbers of pieces of data from each of the plurality of cylinders and acquires the plurality of pieces of data from a selected cylinder in preference to other cylinders.

9. The injection quantity controller according to claim 8, wherein the selected cylinder includes the cylinder having one of the largest number and the smallest number of pieces of data previously acquired therefrom.

10. The injection quantity controller according to claim 1, wherein the data determiner determines whether acquired data is usable based on one of a vehicle traveling distance and an operation frequency of the injector.

11. The injection quantity controller according to claim 1, wherein the at least one learning condition includes a non-injection time defined as an instance when the command quantity indicated to the injector is less than or equal to zero.

12. A method of controlling an injection quantity for an engine, comprising:

determining whether at least one predetermined learning condition is satisfied;

injecting a command quantity of fuel into at least one of a plurality of cylinders of the engine when the at least one learning condition is satisfied;

acquiring a plurality of pieces of data for at least one of the plurality of cylinders, the plurality of pieces of data representing a change of an operating state of the engine caused by injecting the command quantity of fuel;

identifying which of the plurality of pieces of data are usable;

calculating a correction quantity based on the pieces of data determined to be usable; and correcting the command quantity according to the correction quantity.

13. The method according to claim 12, wherein identifying which of the plurality of pieces of data are usable occurs only after a number of the plurality of pieces of data is at least equal to a prescribed count.

14. The method according to claim 13, wherein the plurality of pieces of data are identified as usable when a difference between when an oldest piece of data was acquired and when a latest piece of data was acquired is less than a prescribed time.

15. The method according to claim 12, wherein each of the plurality of pieces of data is identified as usable when acquired before a first expiration time defined as being a prescribed time after the oldest piece of data was acquired.

16. The method according to claim 15, wherein each of the plurality of pieces of data is identified as usable when acquired after a second expiration defined as being the prescribed time before the latest piece of data was acquired.

17. The method according to claim 12, further comprising assigning a weight factor to each of the plurality of pieces of data identified as being usable, wherein later pieces of acquired data are assigned a higher weight factor than older pieces of acquired data such that the correction quantity is calculated according to the weight factors.

18. The method according to claim 12, wherein acquiring the plurality of pieces of data starts from a first cylinder to reach a top dead center after at least one learning condition is satisfied.

19. The method according to claim 12, wherein acquiring the plurality of pieces of data includes comparing the numbers of pieces of data acquired from each of the plurality of cylinders and acquiring the plurality of pieces of data from a selected cylinder in preference to other cylinders, wherein the selected cylinder includes the cylinder having one of the largest number and the smallest number of pieces of data previously acquired therefrom.

20. The method according to claim 12, wherein identifying which of the plurality of pieces of acquired data are usable is based on one of a vehicle traveling distance and an operation frequency of an injector.

* * * * *